US009102489B2

(12) United States Patent
Uohashi

(10) Patent No.: US 9,102,489 B2
(45) Date of Patent: Aug. 11, 2015

(54) SHEET FEEDING DEVICE AND IMAGE FORMING APPARATUS PROVIDED WITH THE SHEET FEEDING DEVICE

(71) Applicant: KYOCERA Document Solutions Inc., Osaka (JP)

(72) Inventor: Yuki Uohashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/523,108

(22) Filed: Oct. 24, 2014

(65) Prior Publication Data

US 2015/0115520 A1 Apr. 30, 2015

(30) Foreign Application Priority Data

Oct. 28, 2013 (JP) ..... 2013-223163

(51) Int. Cl.

| | |
|---|---|
| ***B65H 1/22*** | (2006.01) |
| ***B65H 1/26*** | (2006.01) |
| ***B65H 1/04*** | (2006.01) |
| ***B65H 3/06*** | (2006.01) |
| ***B65H 5/06*** | (2006.01) |
| ***B65H 1/02*** | (2006.01) |
| ***B65H 3/52*** | (2006.01) |

(52) U.S. Cl.

CPC ..... *B65H 1/266* (2013.01); *B65H 1/027* (2013.01); *B65H 1/04* (2013.01); *B65H 1/26* (2013.01); *B65H 3/06* (2013.01); *B65H 3/52* (2013.01); *B65H 3/5207* (2013.01); *B65H 3/5246* (2013.01); *B65H 3/5253* (2013.01); *B65H 3/5261* (2013.01); *B65H 5/062* (2013.01); *B65H 2404/144* (2013.01); *B65H 2404/1441* (2013.01); *B65H 2404/152* (2013.01); *B65H 2404/1521* (2013.01); *B65H 2405/12* (2013.01); *B65H 2405/121* (2013.01)

(58) Field of Classification Search

CPC ..... B65H 1/027; B65H 1/04; B65H 1/26; B65H 1/266; B65H 3/06; B65H 3/46; B65H 3/52; B65H 3/5207; B65H 3/523; B65H 3/5215; B65H 3/5246; B65H 3/5253; B65H 3/5261; B65H 5/062; B65H 2404/144; B65H 2404/1441; B65H 2404/1442; B65H 2404/152; B65H 2404/1521; B65H 2405/12; B65H 2405/121

See application file for complete search history.

(56) References Cited

U.S. PATENT DOCUMENTS 5,277,418 A * 1/1994 Jones et al. ..... 271/164
5,383,655 A * 1/1995 Hayakawa et al. ..... 271/10.01

(Continued)

FOREIGN PATENT DOCUMENTS

JP 2011-201682 10/2011

*Primary Examiner* — Prasad Gokhale
(74) *Attorney, Agent, or Firm* — Wenderoth, Lind & Ponack, L.L.P.

(57) ABSTRACT

A sheet feeding cassette is capable of being mounted to and removed from an apparatus body along a specified mounting direction. The sheet accommodated within a sheet accommodating portion is conveyed through a sheet conveyance path in a sheet conveyance direction extending along the mounting direction. A sheet feeding roller is disposed at an inlet side of the sheet conveyance path so as to face the sheet accommodating portion. A retard roller is disposed so as to face the sheet feeding roller. The sheet feeding roller forms a sheet feeding nip between the sheet feeding roller and the retard roller. A lock mechanism locks drawing-out of the sheet feeding cassette from the apparatus body or releases the lock. A separator moves the retard roller away from the sheet feeding roller prior to or simultaneously with the lock being released by the lock mechanism.

10 Claims, 13 Drawing Sheets

(56) References Cited

U.S. PATENT DOCUMENTS 6,375,183 B1 * 4/2002 Inoue et al. ..... 271/10.11
2012/0025453 A1 * 2/2012 Yamaguchi et al. ..... 271/225
2012/0126475 A1 * 5/2012 Shin et al. ..... 271/117
2012/0326382 A1 * 12/2012 Hayayumi ..... 271/117
2014/0042687 A1 * 2/2014 Taoka et al. ..... 271/9.01
2015/0028536 A1 * 1/2015 Takai et al. ..... 271/117

* cited by examiner

SHEET FEEDING DEVICE AND IMAGE FORMING APPARATUS PROVIDED WITH THE SHEET FEEDING DEVICE

CROSS-REFERENCE TO RELATED APPLICATION

This application is based upon and claims the benefit of priority from Japanese Patent Application No. 2013-223163 filed on Oct. 28, 2013, the entire contents of which are incorporated herein by reference.

BACKGROUND

The technology of the present disclosure relates to a sheet feeding device and an image forming apparatus provided with the sheet feeding device.

In the related art, a sheet feeding device mounted to an image forming apparatus is known as a sheet feeding device for feeding a sheet. The sheet feeding device includes a sheet feeding cassette removably mounted to an apparatus body of an image forming apparatus, a pickup roller disposed in the apparatus body, a sheet feeding roller and a retard roller. Sheets are accommodated within the sheet feeding cassette. As the pickup roller is rotated, a sheet is fed in a sheet conveyance direction.

The sheet fed by the pickup roller is carried into a sheet feeding nip formed by the sheet feeding roller and the retard roller. By the rotation of the sheet feeding roller, the sheet is further conveyed toward the downstream side in the sheet conveyance direction.

In the image forming apparatus of this kind, a sheet conveyance path is often formed to extend along the mounting direction of the sheet feeding cassette within the apparatus body. In the image forming apparatus, a sheet scattering prevention member capable of protruding into and retracting from the sheet conveyance path is provided in order to prevent a sheet from scattering during the mounting process of the sheet feeding cassette and entering the sheet feeding nip.

SUMMARY

A sheet feeding device according to one aspect of the present disclosure includes an apparatus body, a sheet feeding cassette, a sheet conveyance path, a sheet feeding roller, a retard roller, a lock mechanism and a separator. The sheet feeding cassette is capable of being mounted to and removed from the apparatus body along a specified mounting direction and is provided with a sheet accommodating portion within which a sheet is accommodated. The sheet conveyance path is disposed in the apparatus body. The sheet accommodated within the sheet accommodating portion is conveyed through the sheet conveyance path in a sheet conveyance direction extending along the mounting direction. The sheet feeding roller is disposed at an inlet side of the sheet conveyance path so as to face the sheet accommodating portion. The sheet feeding roller is rotationally driven to convey the sheet in the sheet conveyance direction. The retard roller is disposed so as to face the sheet feeding roller. The retard roller makes contact with the sheet feeding roller to form a sheet feeding nip, through which the sheet passes, between the sheet feeding roller and the retard roller. The lock mechanism is disposed in the sheet feeding cassette and the apparatus body. The lock mechanism locks drawing-out of the sheet feeding cassette from the apparatus body or releases the lock. The separator moves the retard roller away from the sheet feeding roller prior to or simultaneously with the lock being released by the lock mechanism.

DETAILED DESCRIPTION

Figure 1:
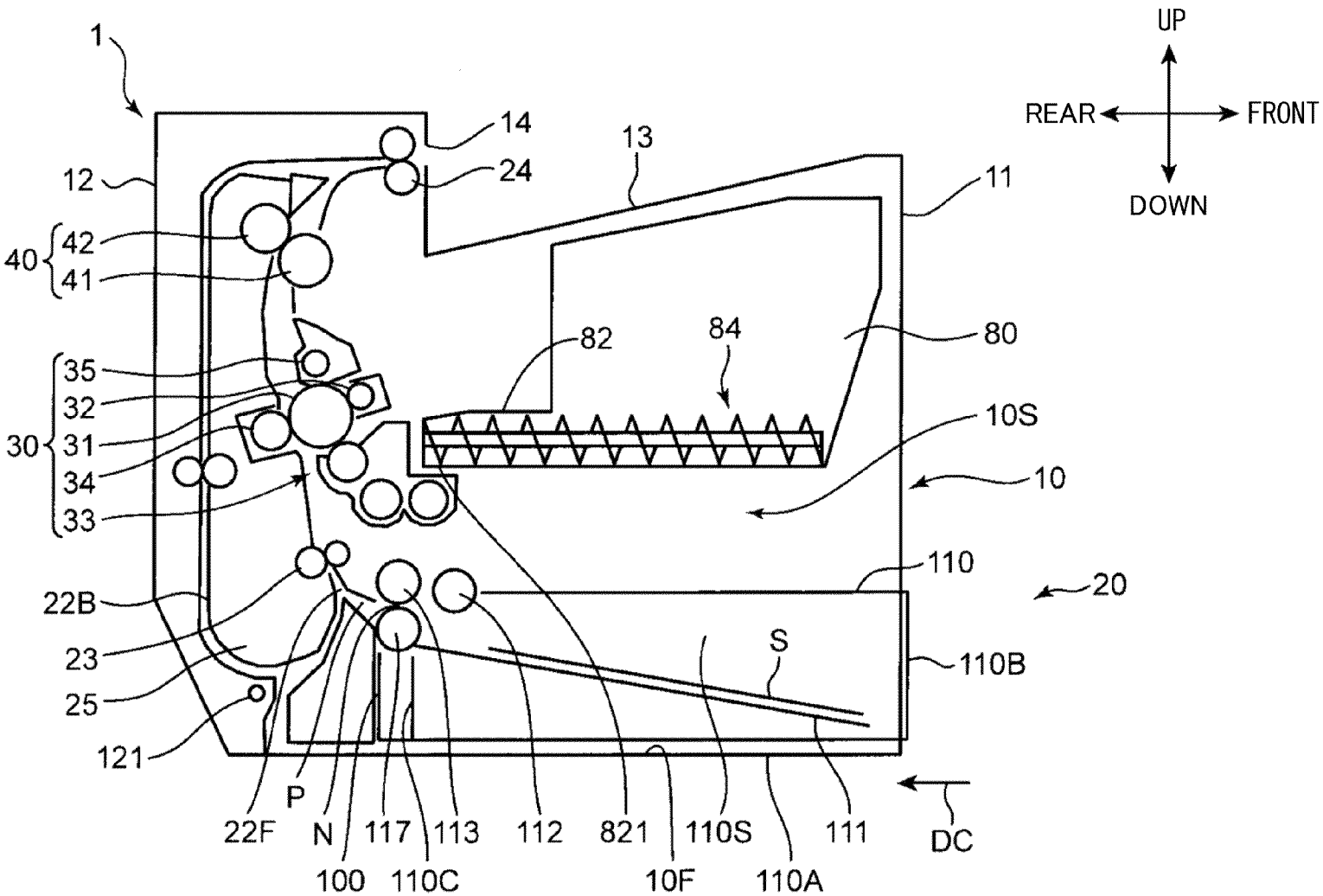
FIG. 1 is a sectional view schematically showing the internal structure of an image forming apparatus according to one aspect of the present disclosure.

Embodiments of the present disclosure will now be described in detail with reference to the accompanying drawings. FIG. 1 is a side sectional view showing the internal structure of an image forming apparatus 1 according to an embodiment. While a monochrome printer is illustrated herein as an example of the image forming apparatus 1, the image forming apparatus 1 may be a copier, a facsimile apparatus or a multifunction peripheral having the functions thereof. Moreover, the image forming apparatus 1 may be an image forming apparatus for forming a color image.

The image forming apparatus 1 includes a body housing 10 (an apparatus body) having a substantially rectangular parallelepiped housing structure, an image forming unit 30 accommodated within the body housing 10, a fixing unit 40, a toner container 80 and a sheet feeding unit 20.

A front cover 11 is provided at the front surface side of the body housing 10. A rear cover 12 is provided at the rear surface side of the body housing 10. As the front cover 11 is opened, the toner container 80 is exposed toward the front surface side. Thus, when a toner runs out, a user can take out the toner container 80 from the front surface side of the body housing 10. The rear cover 12 is a cover which is opened at the occurrence of sheet jam or during the maintenance. As the rear cover 12 is opened, the image forming unit 30 and the fixing unit 40 can be taken out from the rear surface side of the body housing 10. Different kinds of devices for implementing image formation are installed within an internal space 10S defined by the front cover 11, the rear cover 12 and a sheet discharge part 13. The body housing 10 includes a body bottom portion 10F. The body bottom portion 10F is a bottom portion of the body housing 10. At the upper side of the body bottom portion 10F, a sheet feeding cassette 110 to be described later is mounted to or removed from the body housing 10.

The image forming unit 30 performs an image forming process by which a toner image is formed on a sheet S sent from the sheet feeding unit 20. The image forming unit 30 includes a photosensitive drum 31, a charging device 32, an exposure device (not shown in FIG. 1), a developing device 33, a transfer roller 34 and a cleaning device 35. The charging device 32, the exposure device (not shown in FIG. 1), the developing device 33, the transfer roller 34 and the cleaning device 35 are disposed around the photosensitive drum 31.

The photosensitive drum 31 includes a rotation shaft and a cylindrical surface rotating about the rotation shaft. An electrostatic latent image is formed on the cylindrical surface. A toner image corresponding to the electrostatic latent image is carried on the cylindrical surface.

The charging device 32, which uniformly charges the surface of the photosensitive drum 31, includes a charging roller that makes contact with the photosensitive drum 31.

The cleaning device 35 includes a cleaning blade not shown. The cleaning device 35 cleans the toner adhering to the circumferential surface of the photosensitive drum 31 after the transfer of the toner image and conveys the toner to a recovery device not shown.

The exposure device includes a laser light source and optical system elements such as a mirror, a lens and the like. The exposure device irradiates the light, which is modulated based on image data given from an external device such as a personal computer or the like, on the circumferential surface of the photosensitive drum 31, thereby forming an electrostatic latent image. The developing device 33 supplies a toner to the circumferential surface of the photosensitive drum 31 in order to develop the electrostatic latent image existing on the photosensitive drum 31 and to form a toner image.

The transfer roller 34 is a roller for transferring the toner image formed on the circumferential surface of the photosensitive drum 31 to a sheet. The transfer roller 34 makes contact with the cylindrical surface of the photosensitive drum 31, thereby forming a transfer nip. A transfer bias voltage having a polarity opposite to the polarity of the toner is applied to the transfer roller 34.

The fixing unit 40 performs a fixing process by which the transferred toner image is fixed onto the sheet. The fixing unit 40 includes a fixing roller 41 provided with a heating source therein, and a pressing roller 42 pressed against the fixing roller 41 and configured to form a fixing nip between the fixing roller 41 and the pressing roller 42. If the sheet S to which the toner image has been transferred passes through the fixing nip, the toner image is fixed onto the sheet S by the heating operation of the fixing roller 41 and the pressing operation of the pressing roller 42.

The toner container 80 retains a refilling toner to be refilled to the developing device 33. As a rotary member 84 is rotationally driven, the refilling toner retained within the toner container 80 is supplied from a toner outlet 821 formed on a lower surface of a front end of a tubular portion 82 into the developing device 33.

The sheet feeding unit 20 includes a sheet feeding cassette 110 that accommodates sheets S to be subjected to an image forming process. The sheet feeding cassette 110 includes a sheet accommodating portion 1105 for accommodating a bundle of sheets S, a lift plate 111 for lifting up the bundle of sheets S to feed each of the sheets, and so forth. The sheet S is carried into a below-mentioned main conveyance path 22F extending from the sheet feeding cassette 110 into the body housing 10. The sheet feeding cassette 110 will be described in detail later.

In order to convey the sheet S, a main conveyance path 22F (sheet conveyance path) and an inverting conveyance path 22B are provided within the body housing 10. The main conveyance path 22F extends from the sheet accommodating portion 1105 to a sheet discharge hole 14, which is formed to face the sheet discharge part 13 existing on the top surface of the body housing 10, via the image forming unit 30 and the fixing unit 40. The inverting conveyance path 22B is a conveyance path for, when double side printing is to be performed with respect to the sheet S, returning a one-side-printed sheet S to the upstream side of the image forming unit 30 in the main conveyance path 22F.

The main conveyance path 22F extends so as to pass through a transfer nip, which is formed by the photosensitive drum 31 and the transfer roller 34, from the lower side toward the upper side. A registration roller pair 23 is disposed in the main conveyance path 22F at the upstream side of the transfer nip. The sheet S is stopped in the registration roller pair 23 and is subjected to skew correction. Thereafter, the sheet S is sent to the transfer nip at a predetermined timing suitable for the image transfer. A plurality of conveyance rollers for conveying the sheet S is disposed at suitable locations of the main conveyance path 22F and the inverting conveyance path 22B. For example, a sheet discharge roller pair 24 is disposed near the sheet discharge hole 14.

The inverting conveyance path 22B is formed between the outer side surface of an inverting unit 25 and the inner surface of the rear cover 12 of the body housing 10. One of the transfer roller 34 and the registration roller pair 23 is mounted to the inner side surface of the inverting unit 25. The rear cover 12 and the inverting unit 25 can be swung about a body pivot portion 121 installed at the lower end thereof. In case where sheet jam occurs in the inverting conveyance path 22B, the rear cover 12 is opened. If sheet jam occurs in the main conveyance path 22F or when the unit of the photosensitive drum 31 and the developing device 33 are taken out to the outside, the inverting unit 25 is opened in addition to the rear cover 12.

<As for the Sheet Feeding Unit>

Figure 2:
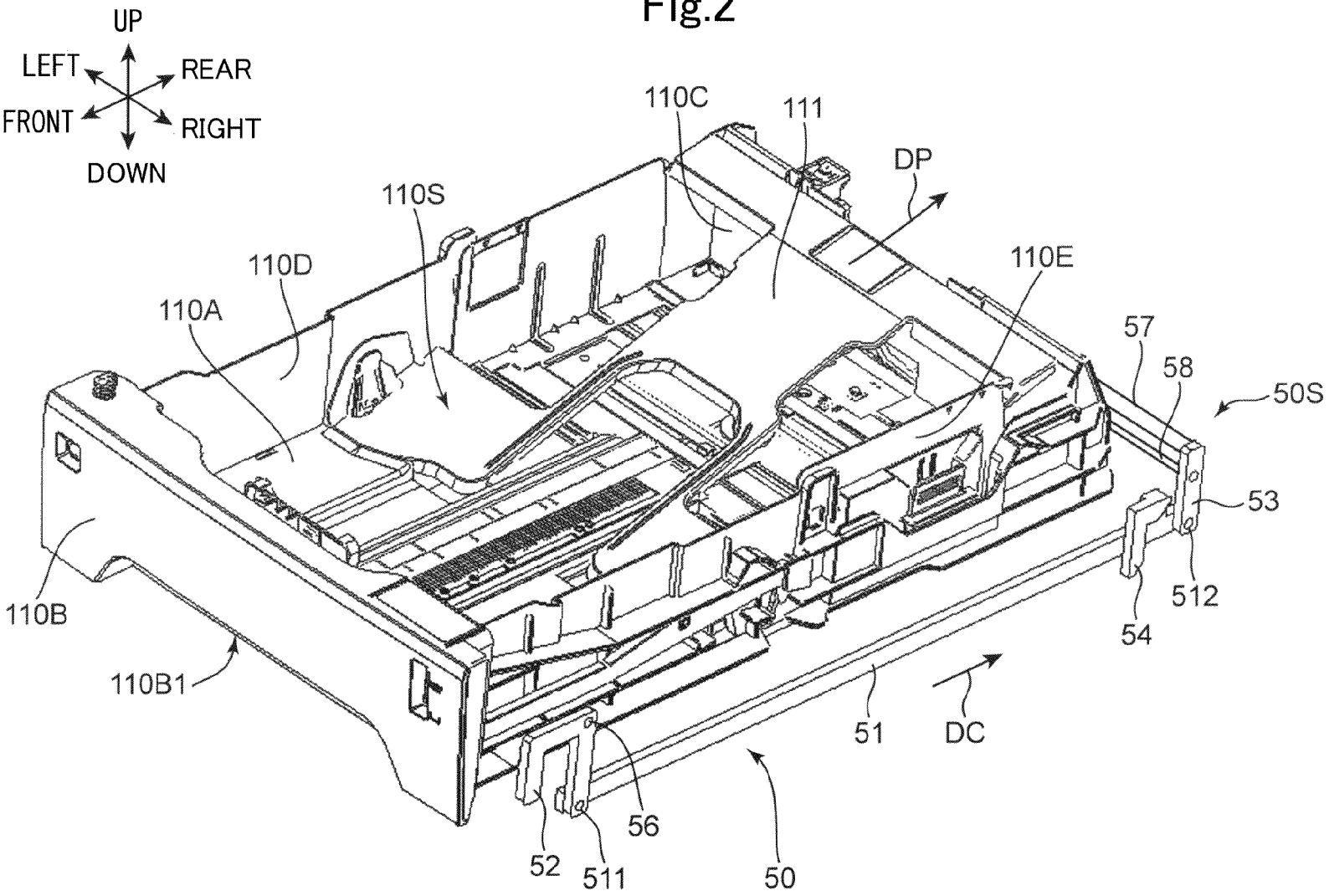
FIG. 2 is a perspective view of a sheet feeding cassette according to an embodiment.
Figure 3A:
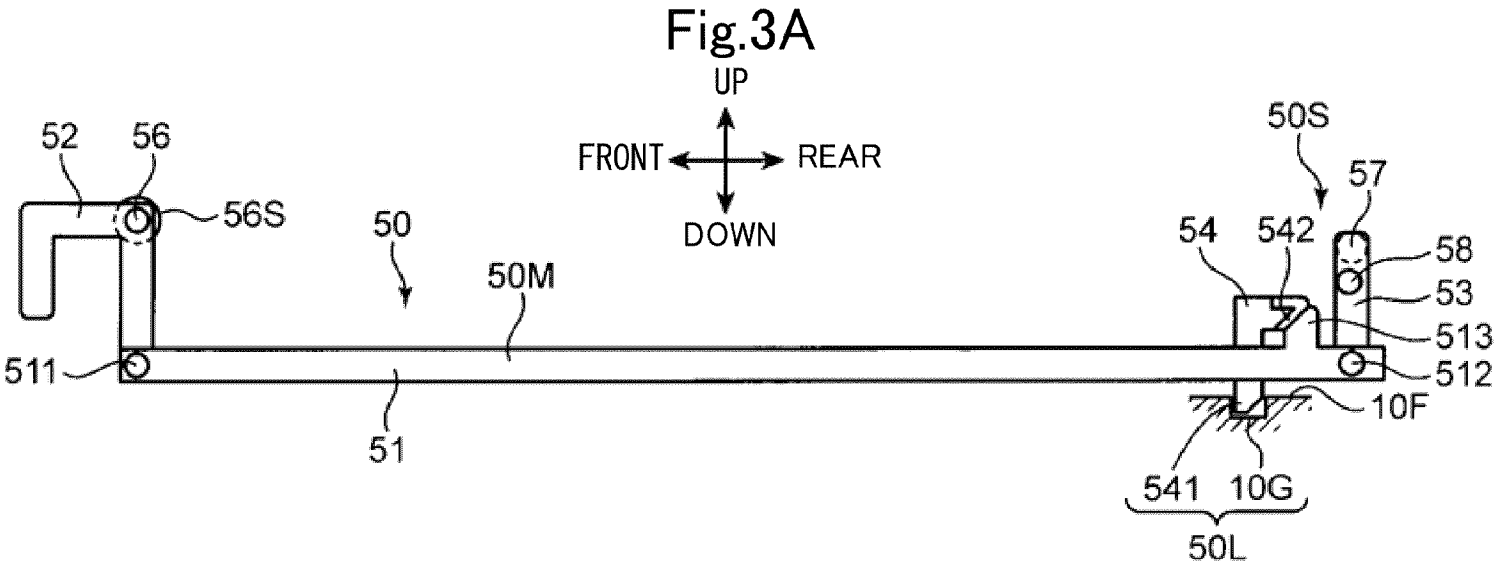
FIG. 3A is a side view of a lock mechanism according to an embodiment.
Figure 3B:
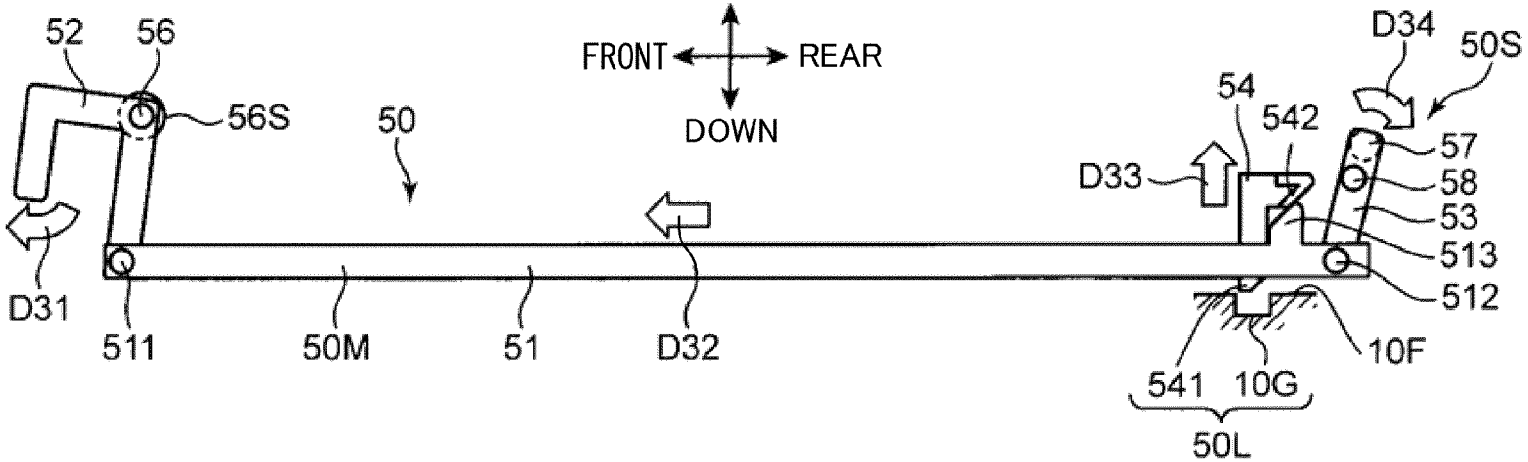
FIG. 3B is a side view of a lock mechanism according to an embodiment.
Figure 4:
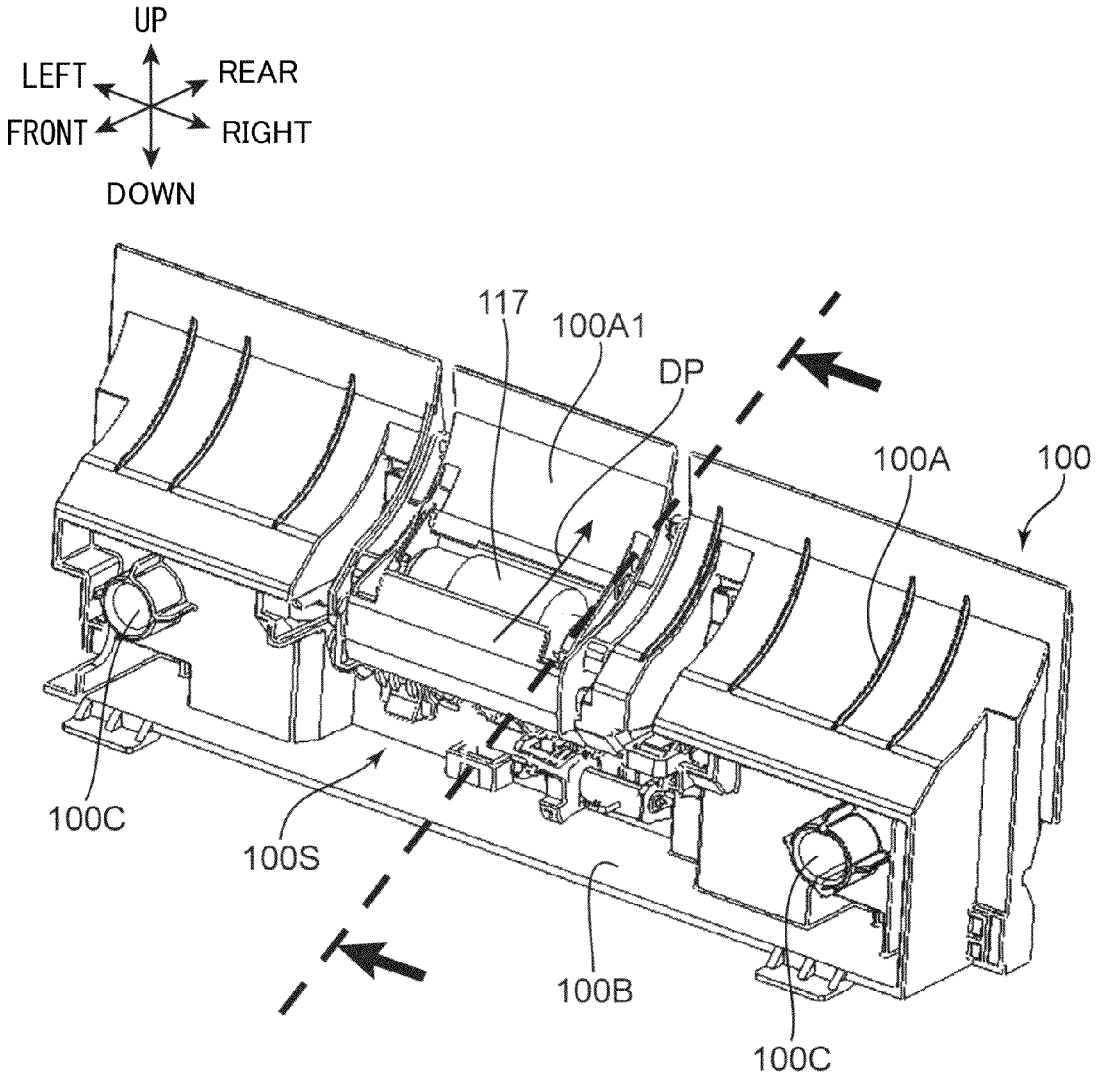
FIG. 4 is a perspective view of a part of an apparatus body of an image forming apparatus according to an embodiment.
Figure 5:
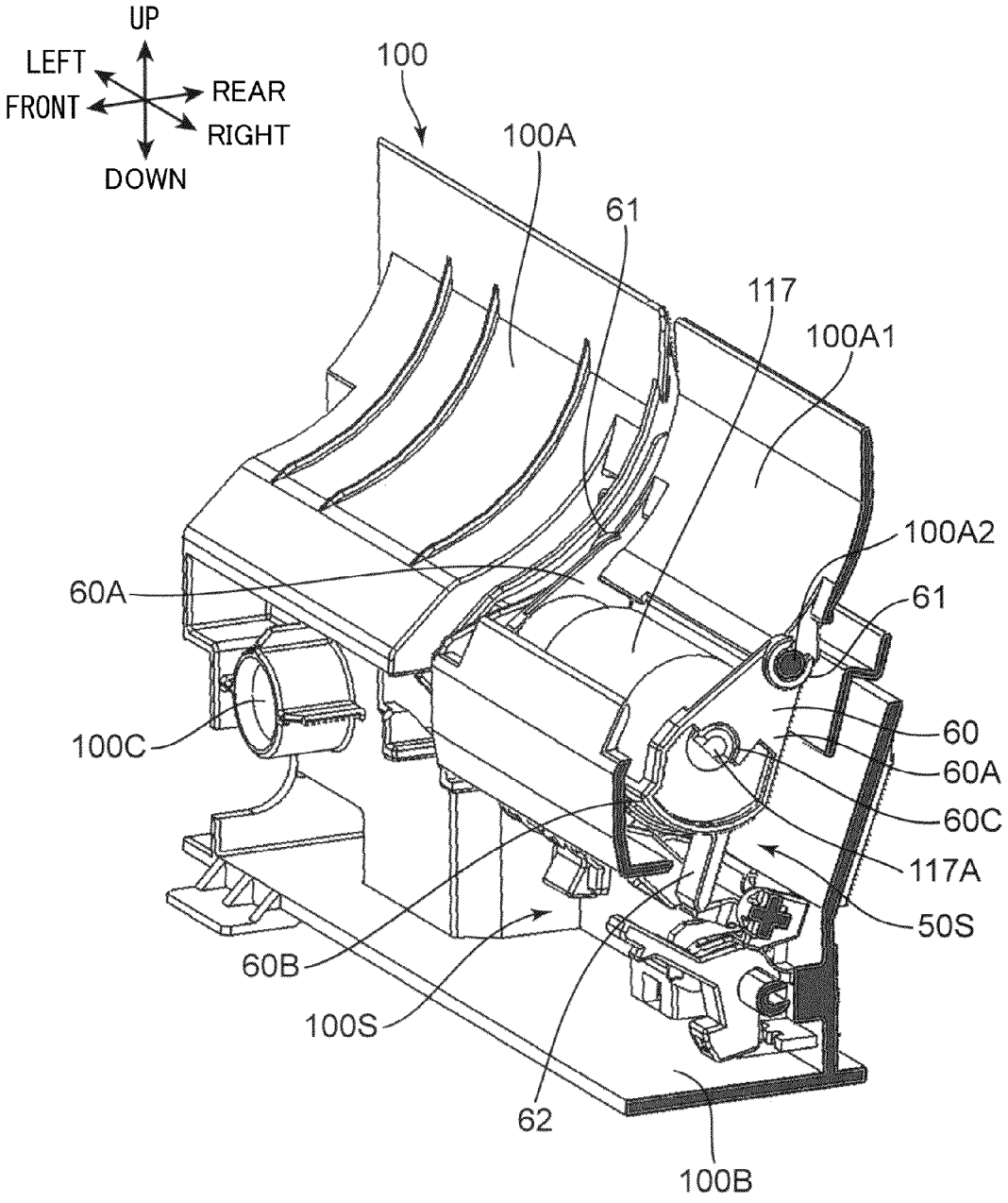
FIG. 5 is a sectional perspective view of a part of the apparatus body shown in FIG. 4.
Figure 6:
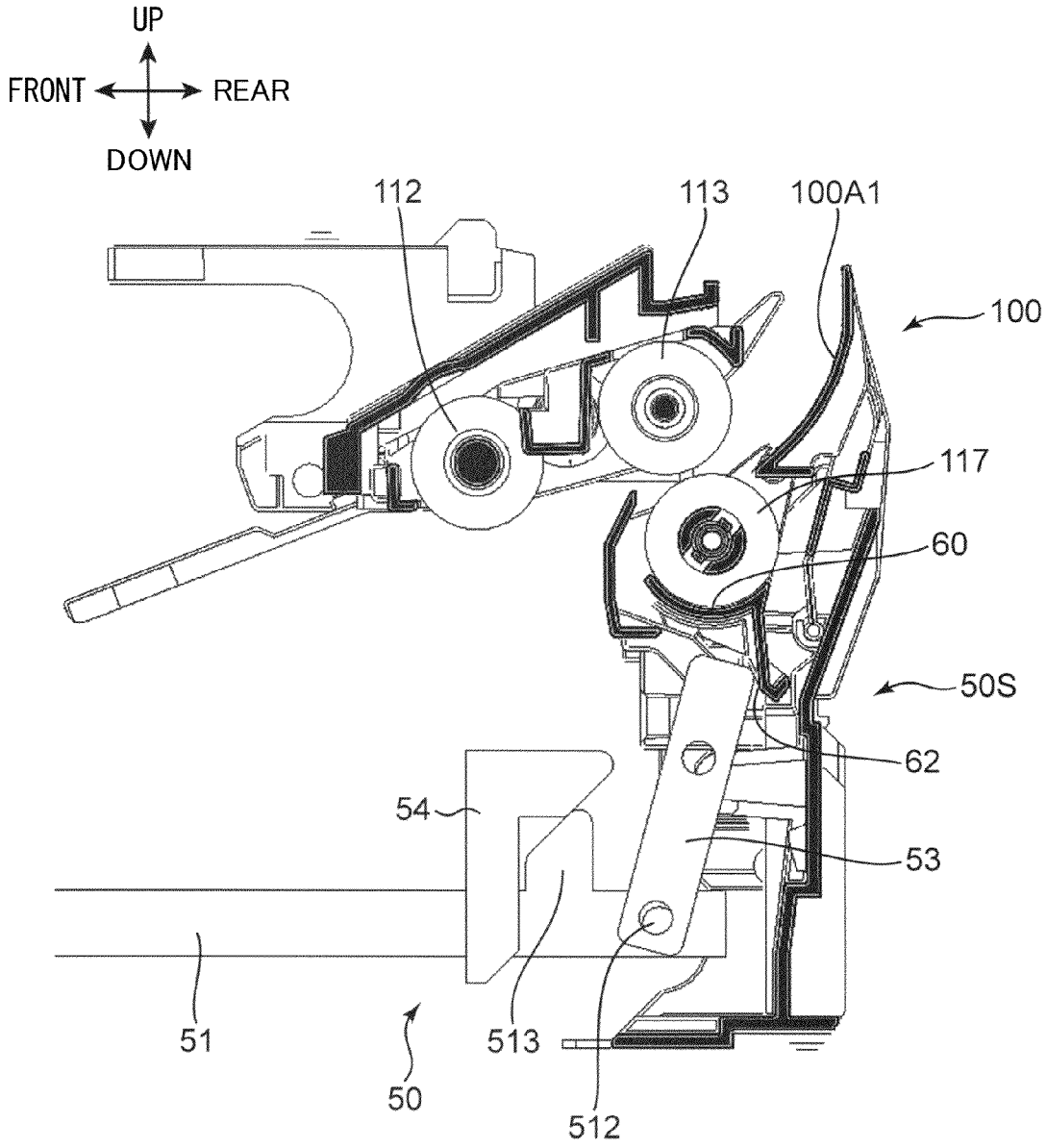
FIG. 6 is a sectional view showing the surrounding of a retard roller according to an embodiment.

Next, the sheet feeding unit 20 (the sheet feeding device) according to an embodiment will be described in detail with reference to FIGS. 2 to 6 as well as FIG. 1. The sheet feeding unit 20 includes the aforementioned sheet feeding cassette 110 and a guide wall unit 100. FIG. 2 is a perspective view of the sheet feeding cassette 110 according to an embodiment. FIGS. 3A and 3B are side views of a lock mechanism 50 according to an embodiment. FIG. 4 is a perspective view of the guide wall unit 100. FIG. 5 is a sectional perspective view of the guide wall unit 100 shown in FIG. 4. FIG. 6 is a sectional view showing the surrounding structure of a retard roller 117.

The sheet feeding cassette 110 can be mounted to or removed from the body housing 10 (the apparatus body) along a specified mounting direction. In the present embodiment, the sheet feeding cassette 110 is mounted to the body housing 10 along a direction (mounting direction) indicated by an arrow DC in FIGS. 1 and 2. The sheet feeding cassette 110 includes a cassette bottom wall 110A and a sheet accommodating portion 1105. A sheet S is accommodated within the sheet accommodating portion 1105. The sheet S accommodated within the sheet accommodating portion 1105 is conveyed along the main conveyance path 22F (sheet conveyance path). In other words, the main conveyance path 22F is a conveyance path which extends from the sheet accommodating portion 1105 in the body housing 10 and through which the sheet S is conveyed in the sheet conveyance direction (the direction indicated by an arrow DP in FIGS. 2 and 4) extending along the mounting direction. The sheet feeding cassette 110 has a box shape in which wall portions extend upward from the front, rear, left and right sides of the cassette bottom wall 110A. In other words, the sheet feeding cassette 110 further includes a cassette front wall 110B, a cassette rear wall 110C (see FIG. 1), a cassette left wall 110D, a cassette right wall 110E (a sidewall) and a lift plate 111.

The cassette front wall 110B defines the front side of the sheet feeding cassette 110. The cassette front wall 110B is disposed to become flush with the front cover 11 of the body housing 10. The cassette rear wall 110C defines the rear side of the sheet feeding cassette 110. In other words, the cassette rear wall 110C is a wall portion installed upright at the front end in the mounting direction in which the sheet feeding cassette 110 is mounted to the body housing 10. The cassette left wall 110D is a sidewall which intersects the cassette rear wall 110C at the left side of the sheet feeding cassette 110 and which extends along the mounting direction. The cassette right wall 110E is a sidewall which is disposed at the right side of the sheet feeding cassette 110 so as to extend along the mounting direction in parallel with the cassette left wall 110D.

The lift plate 111 is disposed at the side of the bottom portion of the sheet feeding cassette 110. The lift plate 111 is moved upward, thereby moving the sheet-conveyance-direction downstream end portion of the sheet S accommodated in the sheet accommodating portion 1105 toward the pickup roller 112. After the sheet feeding cassette 110 is mounted to the body housing 10, the lift plate 111 is moved up and down by an elevator unit not shown.

The guide wall unit 100 (see FIG. 4) is a unit disposed within the body housing 10 so as to face the sheet feeding cassette 110. The guide wall unit 100 includes a guide surface 100A, a guide wall bottom portion 100B, guide wall hole portions 100C and an entry space 100S. The guide surface 100A is a curved surface disposed in the top surface portion of the guide wall unit 100. The guide surface 100A guides the sheet S sent from the sheet feeding cassette 110 toward the registration roller pair 23 (see FIG. 1). The guide wall bottom portion 100B is a bottom portion of the guide wall unit 100. The guide wall hole portions 100C are a pair of hole portions opened frontward in the left and right opposite end portions of the guide wall unit 100. A pair of shaft portions protruding rearward from the cassette rear wall 110C of the sheet feeding cassette 110 is inserted into the guide wall hole portions 100C, whereby the position of the sheet feeding cassette 110 in the body housing 10 is decided. As shown in FIG. 5, at the upper side of the guide wall bottom portion 100B, there is formed an entry space 100S into which a below-mentioned pressing portion 57 of the sheet feeding cassette 110 can enter.

The sheet feeding unit 20 includes a pickup roller 112, a sheet feeding roller 113 and a retard roller 117.

The pickup roller 112 (see FIG. 1) is disposed in the body housing 10 so as to face the sheet-conveyance-direction downstream end portion of the sheet accommodating portion 1105. The pickup roller 112 is disposed at the upper side of the downstream end portion of the sheet accommodating portion 1105. The pickup roller 112 is disposed in the central portion of the sheet feeding cassette 110 in the sheet width direction (the left-right direction) intersecting the mounting direction of the sheet feeding cassette 110 (the front-rear direction). As the lift plate 111 is moved upward as described above, the sheet-conveyance-direction downstream end portion of the sheet S comes into contact with the pickup roller 112. If the pickup roller 112 is rotated by a drive mechanism not shown, the sheet S is conveyed toward the downstream side in the sheet conveyance direction.

The sheet feeding roller 113 is disposed in the body housing 10 at the sheet-conveyance-direction downstream side of the pickup roller 112. The sheet feeding roller 113 is disposed at the entry side of the main conveyance path 22F so as to face the sheet accommodating portion 1105. The sheet feeding roller 113 is rotationally driven by a drive mechanism not shown, whereby the sheet S sent by the pickup roller 112 is further conveyed toward the downstream side in the sheet conveyance direction.

The retard roller 117 is disposed below the sheet feeding roller 113 so as to face the sheet feeding roller 113. The retard roller 117 forms a sheet feeding nip N (see FIG. 1) for the entry and passage of the sheet S between the retard roller 117 and the sheet feeding roller 113. The aforementioned main conveyance path 22F extends from the sheet accommodating portion 1105 of the sheet feeding cassette 110 so as to pass through the sheet feeding nip N. The retard roller 117 can make a position change between a contact position in which the retard roller 117 makes contact with the sheet feeding roller 113 to form the sheet feeding nip N and a spaced-apart position in which the retard roller 117 is spaced apart downward from the sheet feeding roller 113. In the contact position, the retard roller 117 can be rotationally driven by the sheet feeding roller 113. In case where a plurality of sheets S enters the sheet feeding nip N, only one sheet S existing at the uppermost side is conveyed toward the downstream side in the sheet conveyance direction by the sheet feeding roller 113. The remaining sheets S make contact with the circumferential surface of the retard roller 117 and stops at the sheet feeding nip N.

<As for the Lock Mechanism>

Referring to FIGS. 2 and 3, the sheet feeding unit 20 includes a lock mechanism 50. The lock mechanism 50 is disposed over the sheet feeding cassette 110 and the body housing 10. The lock mechanism 50 includes a lock unit 50L and a release unit 50M. The lock mechanism 50 locks the sheet feeding cassette 110 against the drawing-out from the body housing 10 (locked state) or releases the lock (released state). Referring to FIGS. 3A and 3B, the release unit 50M includes an operating portion 52 and a link portion 51. The lock unit 50L includes an operation biasing spring 56S (a first biasing member), a body recess portion 10G (an engaged portion) and a locking portion 541 (an engaging portion).

The operating portion 52 is a lever which is disposed in the sheet feeding cassette 110 and which can be operated by a user. More specifically, referring to FIG. 2, the sheet feeding cassette 110 includes a grip portion 110B1. The grip portion 110B1 is disposed in the cassette front wall 110B existing at the rear end side in the mounting direction of the sheet feeding cassette 110 and can be gripped during the mounting and removing operation of the sheet feeding cassette 110 to and from the body housing 10. In FIG. 2, for the sake of convenience in description, the operating portion 52 is disposed at the right side of the sheet feeding cassette 110. In reality, however, the operating portion 52 is disposed between the cassette front wall 110B and the grip portion 110B1. More specifically, the operating portion 52 can rotate about a first rotation pivot 56 (a rotation shaft). The first rotation pivot 56 is a shaft portion extending along the left-right direction between the cassette front wall 110B and the grip portion 110B1. The operating portion 52 is fixed to the first rotation pivot 56. Accordingly, a user can operate the below-mentioned link portion 51 by gripping the grip portion 110B1 and the operating portion 52. As a result, the locking and releasing of the lock mechanism 50 are realized.

The operation biasing spring 56S (see FIG. 3) is a coil spring externally fitted to the first rotation pivot 56. The operation biasing spring 56S biases the locking portion 541 toward the body recess portion 10G such that the below-mentioned locking portion 541 engages with the body recess portion 10G (see FIG. 3A).

Referring to FIGS. 3A and 3B, the body recess portion 10G is a recess portion formed in the body bottom portion 10F of the body housing 10. The locking portion 541 can engage with the body recess portion 10G.

The locking portion 541 is disposed in the sheet feeding cassette 110 and is capable of engaging with the body recess portion 10G (the recess portion). More specifically, the sheet feeding cassette 110 includes a stopper 54 (a locking member). The stopper 54 is disposed on the cassette right wall 110E of the sheet feeding cassette 110. In FIG. 2, the stopper 54 is spaced apart rightward from the cassette right wall 110E. In reality, however, the stopper 54 is supported by a support portion (not shown) disposed on the cassette right wall 110E. The stopper 54 is slidable in the up-down direction. Referring to FIGS. 3A and 3B, the stopper 54 extends in the up-down direction. The upper end portion of the stopper 54 has a shape bend rearward. The locking portion 541 is disposed in the lower end portion of the stopper 54. The lower end portion of the locking portion 541 has a partially-cutaway substantially triangular shape. In the meantime, a stopper contacted portion 542 is disposed in the bent portion of the stopper 54. The tip portion of the stopper contacted portion 542 has a substantially triangular shape just like the locking portion 541. In other words, the tip portion of the stopper contacted portion 542 has a slant surface extending upward from the front side toward the rear side.

As shown in FIG. 3A, when the locking portion 541 of the stopper 54 disposed in the sheet feeding cassette 110 engages with the body recess portion 10G of the body housing 10, the sheet feeding cassette 110 is restrained from being drawn out frontward from the body housing 10. That is to say, the lock mechanism 50 comes into the locked state mentioned above. On the other hand, when the stopper 54 is slidingly moved upward from the locked state and when the locking portion 541 is moved away from the body recess portion 10G, the drawing-out of the sheet feeding cassette 110 from the body housing 10 is permitted. That is to say, the lock mechanism 50 comes into the released state mentioned above (see FIG. 3B). In the present embodiment, the link portion 51 connected to the operating portion 52 receives the biasing force of the operation biasing spring 56S and brings the locking portion 541 into engagement with the body recess portion 10G. If the operating portion 52 is operated against the biasing force of the operation biasing spring 56S, the link portion 51 moves the locking portion 541 away from the body recess portion 10G.

The link portion 51 is an elongated plate-like member disposed so as to face the cassette right wall 110E of the sheet feeding cassette 110. The link portion 51 extends in the front-rear direction. The link portion 51 interconnects the operating portion 52 and the stopper 54. The link portion 51 is connected to a below-mentioned separator 50S. The link portion 51 is slidingly moved in the front-rear direction in conjunction with the operation of the operating portion 52. The link portion 51 includes a first link pivot 511, a second link pivot 512 and a stopper pushup portion 513 (a pushup member). The first link pivot 511 is a pivot portion disposed in the front end portion of the link portion 51. The first link pivot 511 rotatably supports the operating portion 52. The second link pivot 512 is a pivot portion disposed in the rear end portion of the link portion 51. The second link pivot 512 rotatably supports a below-mentioned rotation portion 53. The stopper pushup portion 513 is a projection protruding upward from the link portion 51 at the front side of the second link pivot 512. As shown in FIGS. 3A and 3B, the upper end portion of the stopper pushup portion 513 has a slant surface obliquely extending upward from the front side toward the rear side. The slant surface of the stopper pushup portion 513 makes contact with the slant surface of the stopper contacted portion 542.

The operating portion 52 is connected to the front end portion of the link portion 51. The operating portion 52 is a substantially C-like member opened downward. As shown in FIG. 3A, the operating portion 52 includes two side sections extending in the up-down direction at the front side and the rear side, and a side section interconnecting the upper ends of the two side sections in the front-rear direction. The lower end of the rear side section of the operating portion 52 is connected to the link portion 51 at the first link pivot 511.

Referring to FIG. 3A, when the sheet feeding cassette 110 is mounted to the image forming apparatus 1, the locking portion 541 engages with the body recess portion 10G. Therefore, the drawing-out of the sheet feeding cassette 110 is locked. In this case, as shown in FIG. 3A, the slant surfaces of the stopper pushup portion 513 and the stopper contacted portion 542 make contact with each other. On the other hand, if a user of the image forming apparatus 1 wishes to draw out the sheet feeding cassette 110 from the body housing 10, the user operates the operating portion 52 frontward against the biasing force of the operation biasing spring 56S while gripping the grip portion 110B1. At this time, the operating portion 52 is rotated about the first rotation pivot 56 (see an arrow D31 in FIG. 3B). Along with the rotation of the operating portion 52, the first link pivot 511 is moved frontward and the link portion 51 is slidingly moved frontward (see an arrow D32 in FIG. 3B). At this time, as the stopper pushup portion 513 is moved frontward, the slant surface of the stopper pushup portion 513 pushes the slant surface of the stopper contacted portion 542 upward. As a result, the stopper 54 is slidingly moved upward (see an arrow D33 in FIG. 3B) and the locking portion 541 is moved upward away from the body recess portion 10G. That is to say, when the operating portion 52 is operated by the user, the locking portion 541 is moved away from the body recess portion 10G. Thus, the sheet feeding cassette 110 can be drawn out from the body housing 10 (released state).

As described above, in the present embodiment, the drawing-out of the sheet feeding cassette 110 from the body housing 10 is locked by the engagement of the locking portion 541 and the body recess portion 10G. In conjunction with the operation of the operating portion 52, the link portion 51 moves the locking portion 541 away from the body recess portion 10G. Thus, the drawing-out of the sheet feeding cassette 110 is stably realized by the operation of the operating portion 52. At this time, the operating portion 52 is disposed adjacent to the grip portion 110B1 in the mounting direction. Therefore, the operation of the operating portion 52 and the drawing-out of the sheet feeding cassette 110 can be easily realized by the user.

<As for the Spacing Mechanism>

The sheet feeding unit 20 further includes a separator 50S (see FIGS. 3 and 5). In conjunction with the change of the state of the lock mechanism 50 from the locked state to the released state, the separator 50S moves the retard roller 117 from the contact position to the spaced-apart position. Particularly, in the present embodiment, prior to or simultaneously with the lock being released by the lock mechanism 50, the separator 50S moves the retard roller 117 away from the sheet feeding roller 113. The separator 50S includes a holder 60 (a holder), a rotation portion 53, a pressing portion 57 and a second rotation pivot 58.

Referring to FIGS. 4 and 5, the holder 60 rotatably supports the retard roller 117. The holder 60 is disposed at the front and lower side of the guide surface central portion 100A1 of the guide surface 100A. The holder 60 includes a pair of sidewall portions 60A disposed in the left-right direction, an outer wall 60B interconnecting the sidewall portions 60A, and a hole portion 60C. The outer wall 60B is disposed below the retard roller 117 and is formed into a curved shape so as to cover the circumferential surface of the retard roller 117. The hole portion 60C is a hole formed in the central region of each of the sidewall portions 60A. A roller shaft portion 117A for rotatably supporting the retard roller 117 is inserted into the hole portion 60C. As a result, the retard roller 117 is rotatably supported on the holder 60. The holder 60 further includes holder bearing portions 61 (a pivot portion), a pressed portion 62 and a holder biasing spring 63 (a second biasing member).

A pair of holder shaft portions 100A2 is disposed in the left-right-direction opposite end portions of the front end of the guide surface central portion 100A1. The holder shaft portions 100A2 are shaft portions for rotatably pivoting the holder 60. The holder shaft portions 100A2 protrude outward in the left-right direction.

The holder bearing portions 61 are bearing portions disposed in the sidewall portions 60A of the holder 60. The holder bearing portions 61 are rotatably pivoted with respect to the body housing 10. That is to say, when the holder bearing portions 61 are externally fitted to the holder shaft portions 100A2 formed in the guide surface central portion 100A1 of the body housing 10, the holder 60 can rotate about the holder shaft portions 100A2.

The pressed portion 62 is a projection protruding downward from the right end portion of the outer wall 60B of the holder 60. The pressed portion 62 is disposed so as to face the cassette rear wall 110C of the sheet feeding cassette 110 across the entry space 100S. The pressed portion 62 can be pressed by the below-mentioned pressing portion 57.

The holder biasing spring 63 (see FIG. 7) is a biasing spring disposed in a compressed state between the wall portion existing at the rear side of the holder 60 and the wall portion existing at the rear side of the guide wall unit 100. The holder biasing spring 63 biases the holder 60 such that the retard roller 117 is disposed in the contact position. Accordingly, if an external force is not applied to the pressed portion 62, the retard roller 117 is brought into contact with the sheet feeding roller 113 by the biasing force of the holder biasing spring 63.

The rotation portion 53 is connected to the link portion 51. Referring to FIGS. 2 and 3A, the rotation portion 53 is a plate-like member disposed in the rear end portion of the link portion 51 so as to extend in the up-down direction. The lower end portion of the rotation portion 53 is rotatably connected to the link portion 51 at the second link pivot 512.

As shown in FIG. 3A, the second rotation pivot 58 is disposed substantially in the up-down-direction central portion of the rotation portion 53. As shown in FIG. 2, the second rotation pivot 58 is a rod-shaped member that interconnects the rotation portion 53 and the sheet feeding cassette 110. In FIG. 2, the left end portion of the second rotation pivot 58 is not shown. The left end portion of the second rotation pivot 58 is inserted into the bearing portion (not shown) disposed in the cassette rear wall 110C of the sheet feeding cassette 110. The second rotation pivot 58 serves as a rotation pivot that rotatably supports the rotation portion 53.

The pressing portion 57 is a rod-shaped member extending leftward from the upper end portion of the rotation portion 53. In FIG. 2, the left end portion of the pressing portion 57 is not shown. The left end portion of the pressing portion 57 extends to a position where the pressing portion 57 faces the left-right-direction central portion of the cassette rear wall 110C. As the operating portion 52 is operated against the biasing force of the operation biasing spring 56S, the pressing portion 57 presses the pressed portion 62 of the holder 60.

Figure 7:
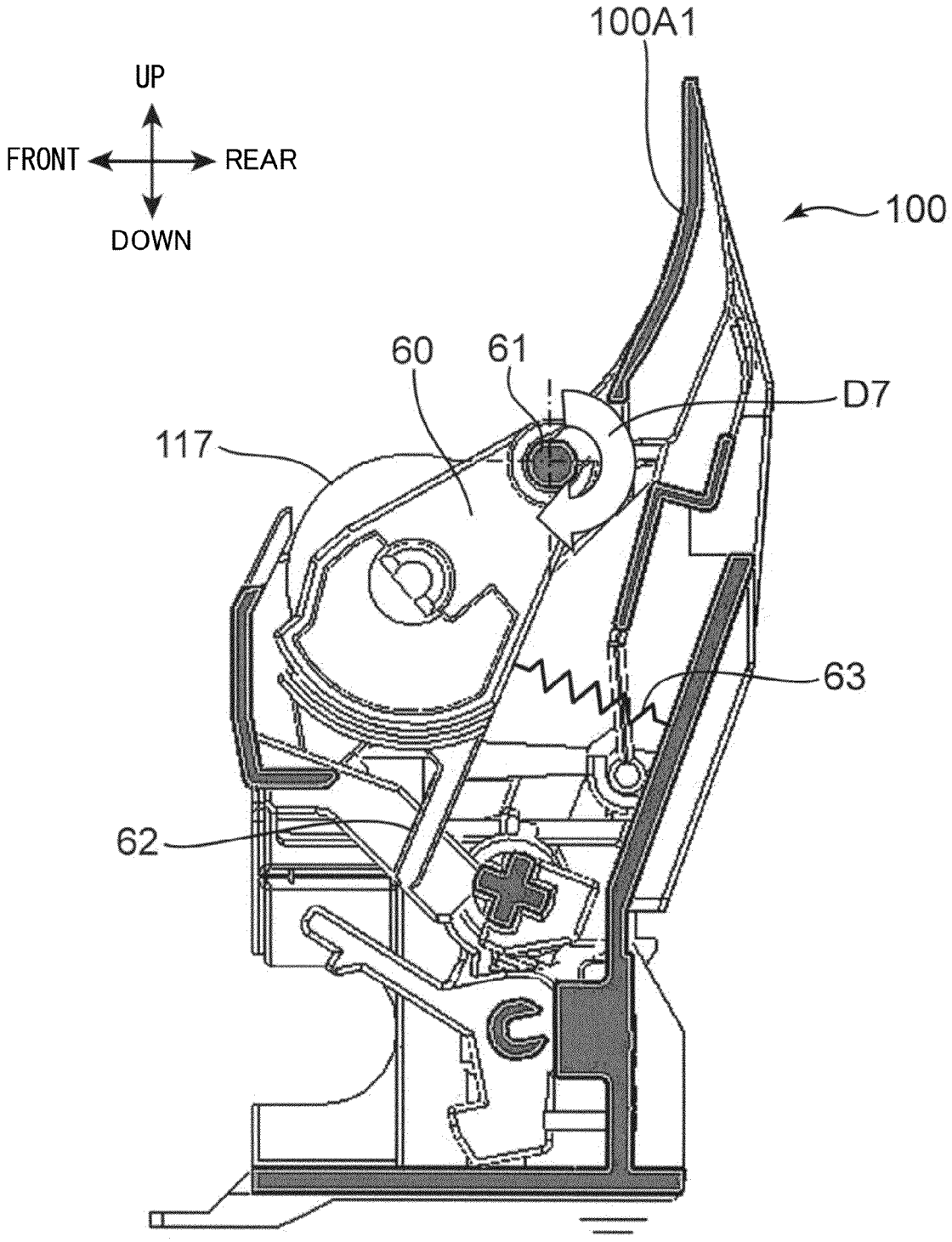
FIG. 7 is a sectional view of the surrounding of the retard roller disposed in a contact position.
Figure 8:
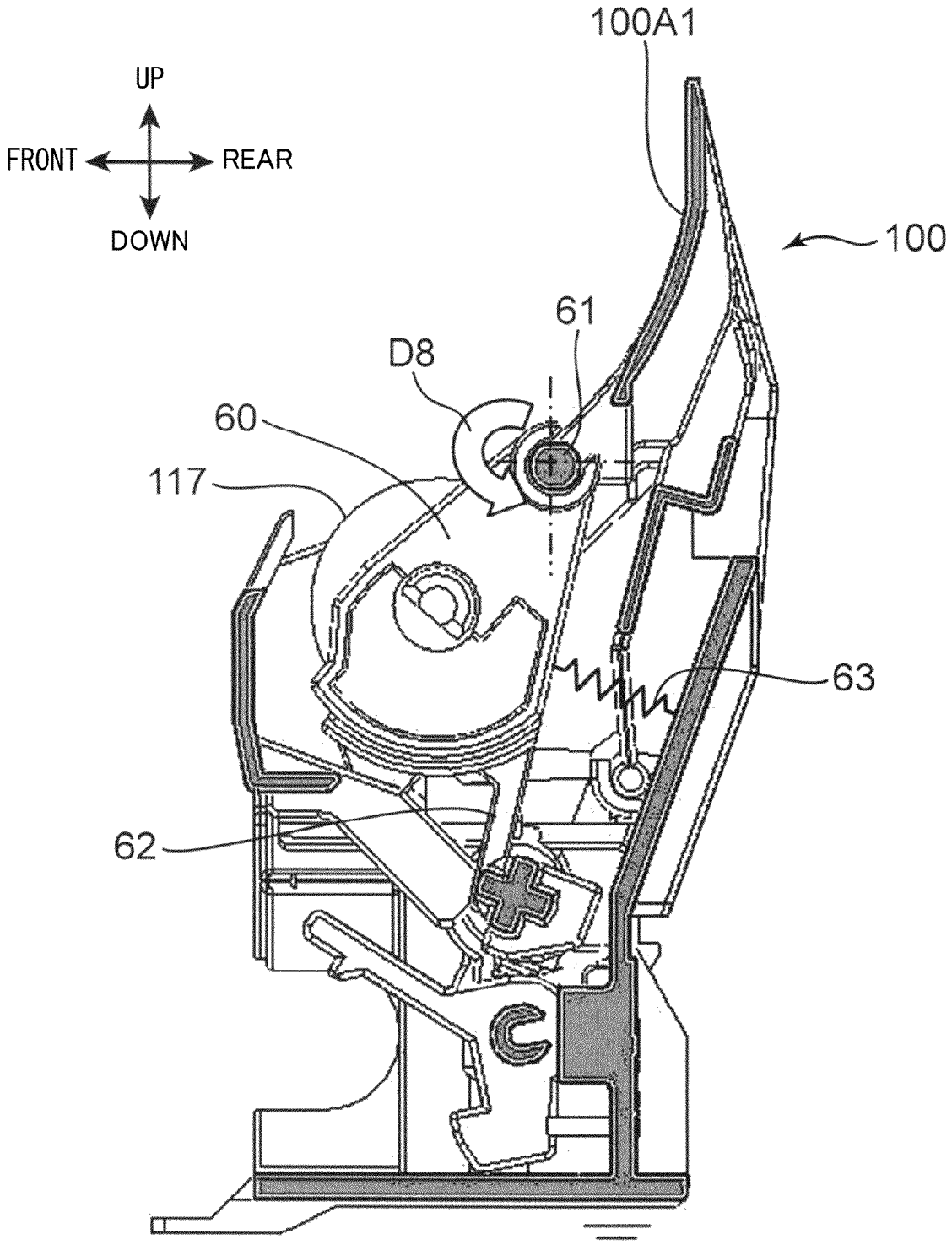
FIG. 8 is a sectional view of the surrounding of the retard roller disposed in a spaced-apart position.

FIG. 7 is a sectional view of the surrounding of the retard roller 117, showing a state in which the retard roller 117 is disposed in the contact position. FIG. 8 is a sectional view of the surrounding of the retard roller 117, showing a state in which the retard roller 117 is disposed in the spaced-apart position.

Referring to FIG. 3A, when the sheet feeding cassette 110 is mounted to the image forming apparatus 1, the rotation portion 53 extends upright from the link portion 51 along the vertical direction. At this time, the pressing portion 57 does not make contact with the pressed portion 62 of the holder 60. Consequently, the holder 60 is rotated about the holder bearing portions 61 by the biasing force of the holder biasing spring 63 (see an arrow D7 in FIG. 7). The retard roller 117 comes into contact with the sheet feeding roller 113 (see FIGS. 7 and 9).

In the meantime, if a user of the image forming apparatus 1 wishes to draw out the sheet feeding cassette 110 from the body housing 10, the user operates (presses) the operating portion 52 frontward against the biasing force of the operation biasing spring 56S while gripping the grip portion 110B1. At this time, as described above, the link portion 51 is slidingly moved frontward through the first link pivot 511 (see an arrow D32 in FIG. 3B). In this case, as the second link pivot 512 is moved frontward, the rotation portion 53 is rotated about the second rotation pivot 58 (see an arrow D34 in FIG. 3B). As a result, the pressing portion 57 presses the pressed portion 62 rearward and the holder 60 rotates about the holder bearing portions 61 against the biasing force of the holder biasing spring 63 (see an arrow D8 in FIG. 8). Thus, the retard roller 117 is spaced apart from the sheet feeding roller 113 (see FIGS. 6 and 8).

Particularly, in the present embodiment, the positions of the respective members and pivots are set such that, prior to or simultaneously with the locking portion 541 being moved away from the body recess portion 10G, the pressing portion 57 presses the pressed portion 62 and the retard roller 117 moves from the contact position to the spaced-apart position. As a result, even if a sheet S is sandwiched in the sheet feeding nip N, the pressing force applied to the sheet S in the sheet feeding nip N is removed prior to or simultaneously with the sheet feeding cassette 110 being drawn out from the body housing 10. In other words, when the sheet feeding cassette 110 is drawn out, the retard roller 117 does not press the sheet S against the sheet feeding roller 113. The sheet feeding cassette 110 is prevented from being drawn out in such a state that the sheet S is sandwiched in the sheet feeding nip N. Particularly, the sheet feeding nip N is opened when the sheet feeding cassette 110 is drawn out. Therefore, the sheet feeding cassette 110 is drawn out while the sheet S sandwiched in the sheet feeding nip N and the remaining sheets S accommodated within the sheet accommodating portion 1105 are brought into contact with each other by a static friction force. For that reason, the sheet S sandwiched in the sheet feeding nip N can be drawn out to the outside of the body housing 10 together with the sheet feeding cassette 110. Thus, the sheet S is prevented from remaining within the body housing 10. With the aforementioned configuration, the retard roller 117 can be moved from the contact position to the spaced-apart position by the rotation of the holder 60 about the holder bearing portions 61. The position change of the retard roller 117 is stably realized by the operation of the operating portion 52.

In order to make sure that the retard roller 117 is moved from the contact position to the spaced-apart position before the sheet feeding cassette 110 comes into a state in which the sheet feeding cassette 110 can be drawn out from the body housing 10, the operating force for operating the operating portion 52 may be set at two stages. That is to say, it may be possible to employ an embodiment in which the pressing portion 57 presses the pressed portion 62 with a small operating force of a first stage and in which the locking portion 541 is moved away from the body recess portion 10G by a large operating force of a second stage. To this end, another biasing spring larger in spring constant than the operation biasing spring 56S may be disposed in the sheet feeding cassette 110 together with the operation biasing spring 56S.

In the present embodiment, the pressing portion 57 of the separator 50S is disposed at the mounting-direction front end side of the sheet feeding cassette 110. The link portion 51 is disposed along the mounting direction of the sheet feeding cassette 110 so as to face the cassette right wall 110E. The operating portion 52 for moving the lock mechanism 50 and the pressing portion 57 is disposed at the mounting-direction rear end side of the sheet feeding cassette 110. Thus, the user's operating force for operating the front part of the sheet feeding cassette 110 can be transferred to the pressing portion 57 existing in the rear part of the sheet feeding cassette 110 through the use of the link portion 51 disposed along the cassette right wall 110E. In other words, by virtue of the link portion 51, the operating motion of the operating portion 52 existing at the mounting-direction rear end side of the sheet feeding cassette 110 can be converted to the pressing motion of the pressing portion 57 existing at the mounting-direction front end side.

Figure 12:
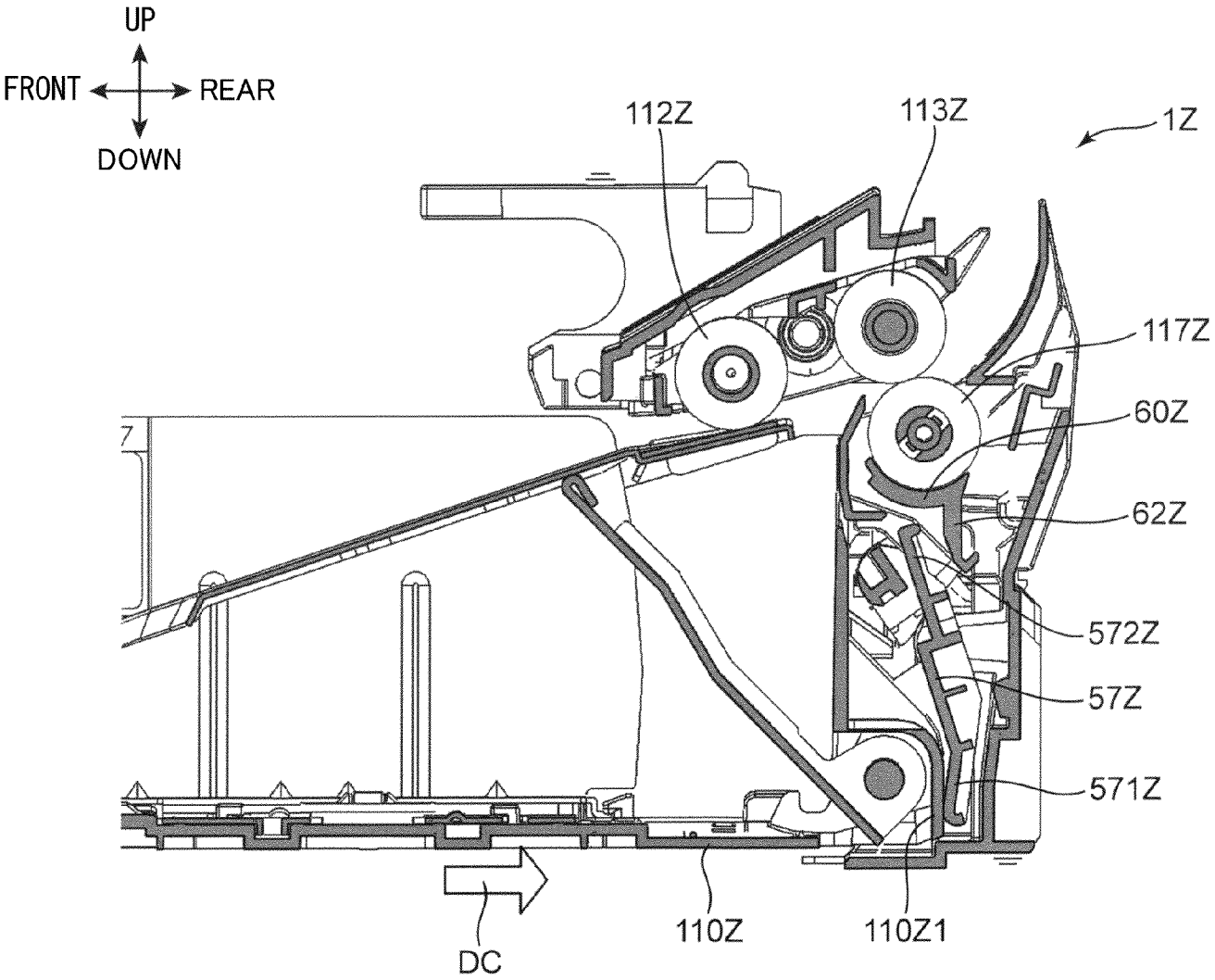
FIG. 12 is a sectional view showing a state in which a retard roller is disposed in a contact position in another image forming apparatus compared with the image forming apparatus according to an embodiment.
Figure 13:
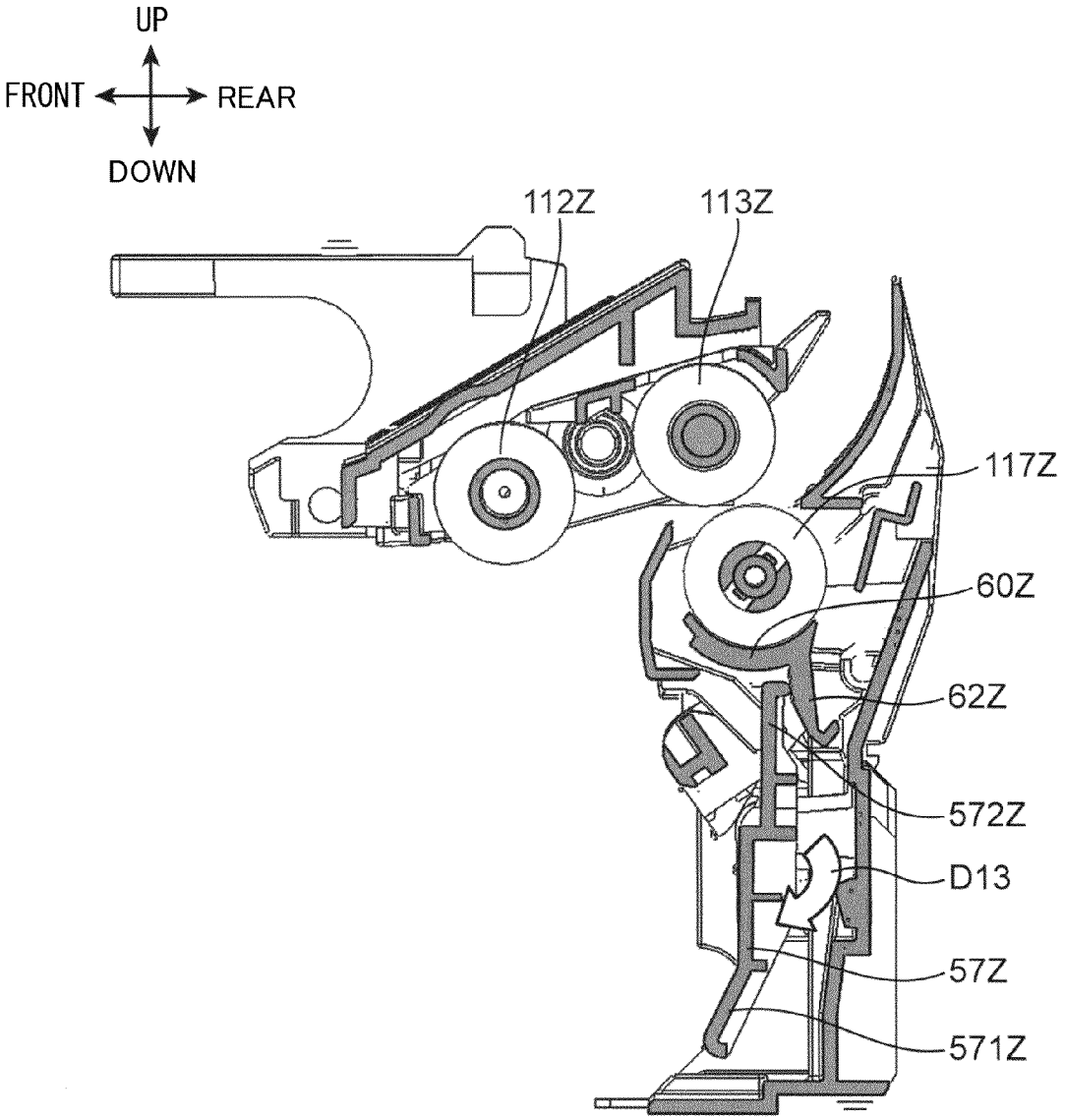
FIG. 13 is a sectional view showing a state in which a retard roller is disposed in a spaced-apart position in another image forming apparatus compared with the image forming apparatus according to an embodiment.

FIG. 12 is a sectional view showing a state in which a retard roller 117Z is disposed in a contact position in another image forming apparatus 1Z compared with the image forming apparatus 1 of the present embodiment. FIG. 13 is a sectional view showing a state in which the retard roller 117Z is disposed in a spaced-apart position in the image forming apparatus 1Z.

Referring to FIGS. 12 and 13, the image forming apparatus 1Z includes a sheet feeding cassette 1102, a pressing piece 57Z and a holder 60Z. The pressing piece 57Z is a member rotatably supported on a wall portion not shown. Referring to FIG. 12, the pressing piece 57Z includes a lower end portion 571Z and an upper end portion 572Z. The pressing piece 57Z is rotatable about a pivot (not shown) disposed between the lower end portion 571Z and the upper end portion 572Z. The holder 60Z rotatably supports the retard roller 117Z. Just like the holder 60 of the present embodiment, the holder 60Z is rotatably supported on a wall portion not shown. The holder 60Z includes a pressed portion 62Z. Along with the rotation of the pressing piece 57Z, the upper end portion 572Z can make contact with the pressed portion 62Z.

As shown in FIG. 12, when the sheet feeding cassette 1102 is mounted to the image forming apparatus 1Z, the contact wall 11021, i.e., the front end portion, of the sheet feeding cassette 1102 makes contact with the lower end portion 571Z of the pressing piece 57Z. Thus, the upper end portion 572Z of the pressing piece 57Z is moved frontward and is therefore disposed in a position spaced apart from the pressed portion 62Z. At this time, the holder 60Z is rotated by the biasing force of a first biasing spring (not shown) disposed in the holder 60Z. The retard roller 117Z is disposed in a contact position where the retard roller 117Z makes contact with a sheet feeding roller 113Z.

On the other hand, when the sheet feeding cassette 1102 begins to be drawn out frontward from the state shown in FIG. 12, the contact wall 11021 of the sheet feeding cassette 1102 begins to move frontward away from the lower end portion 571Z of the pressing piece 57Z. At this time, the pressing piece 57Z begins to be rotted (see an arrow D13 in FIG. 13) by a second biasing spring (not shown) disposed in the pressing piece 57Z. Subsequently, when the contact wall 11021 is completely separated from the lower end portion 571Z, the upper end portion 572Z of the pressing piece 57Z presses the pressed portion 62Z rearward. As a result, the holder 60Z is rotated against the biasing force of the first biasing spring. As shown in FIG. 13, the retard roller 117Z is located in a spaced-apart position where the retard roller 117Z remains spaced apart from the sheet feeding roller 113Z.

However, according to the aforementioned configuration, when the sheet feeding cassette 1102 begins to be drawn out, the retard roller 117Z makes contact with the sheet feeding roller 113Z. For that reason, the sheet A (not shown) nipped between the retard roller 117Z and the sheet feeding roller 113Z cannot follow the sheet feeding cassette 1102 and stays within the apparatus body. On the other hand, in the present embodiment, when the sheet feeding cassette 110 is drawn out, the sheet feeding nip N (see FIG. 1) is released. Therefore, the sheet A is drawn out together with the sheet feeding cassette 110. At this time, the portion of the sheet A other than the front end portion thereof is located within the sheet feeding cassette 110. Therefore, the sheet A is easily drawn out together with the sheet feeding cassette 110. Moreover, friction exists between the sheet A nipped in the sheet feeding nip N and the remaining sheets B accommodated within the sheet feeding cassette 110. Therefore, even if more than one half of the sheet A is fed toward the sheet feeding nip N, the sheet A can follow the sheet feeding cassette 110 during the drawing-out of the sheet feeding cassette 110.

Figure 9:
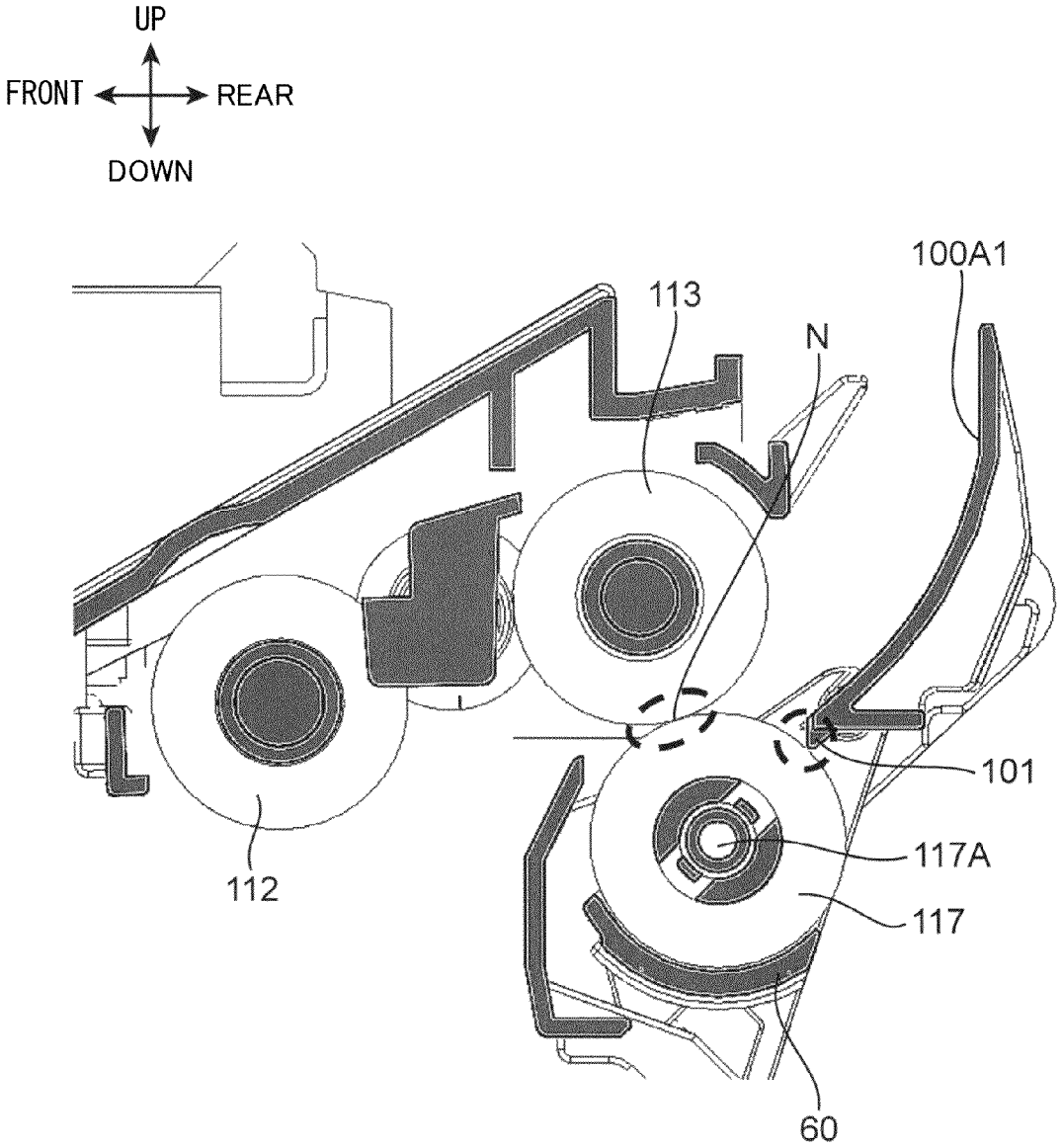
FIG. 9 is a sectional view of the surrounding of the retard roller disposed in a contact position.
Figure 10:
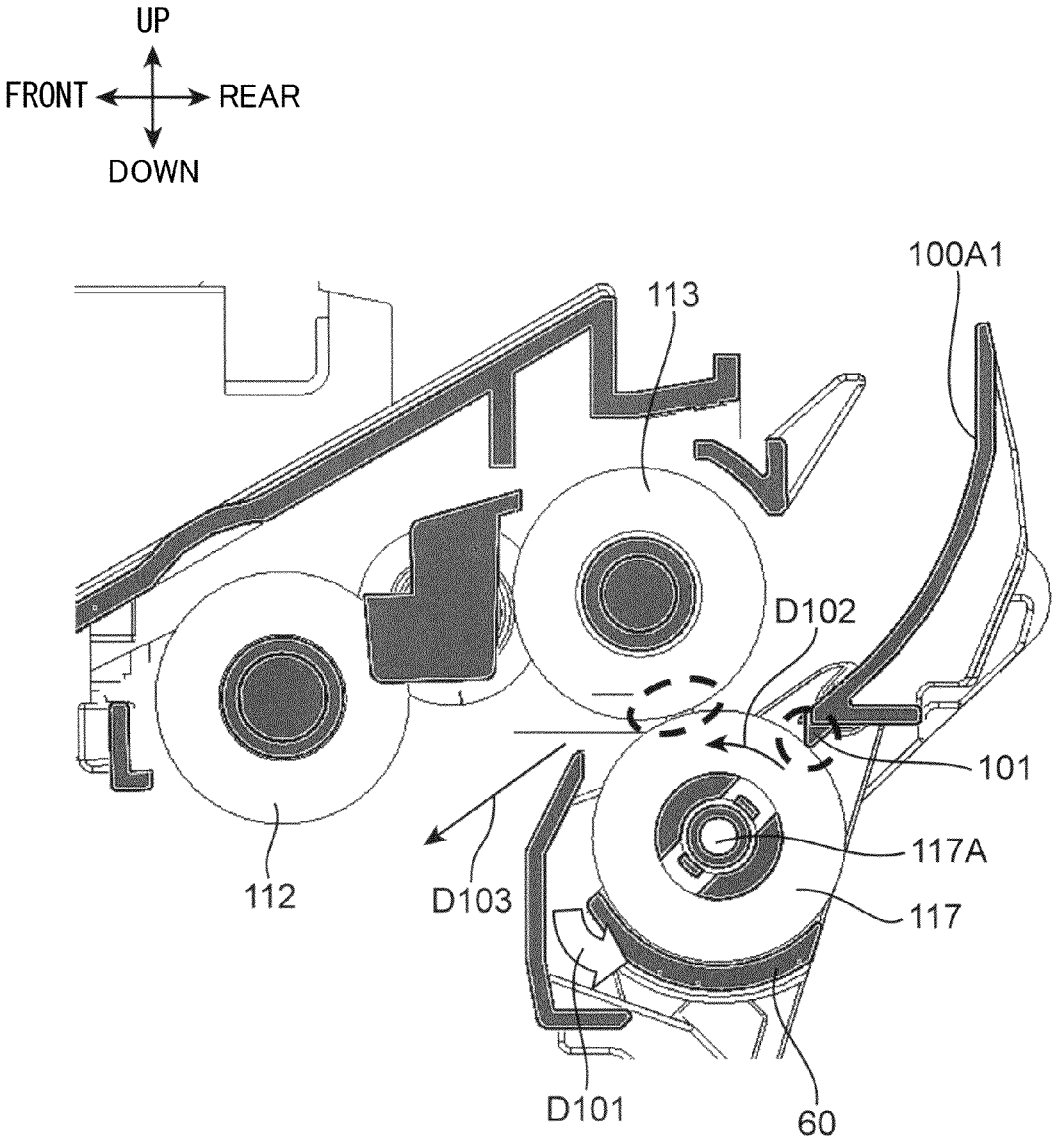
FIG. 10 is a sectional view of the surrounding of the retard roller which is being moved away from a sheet feeding roller.
Figure 11:
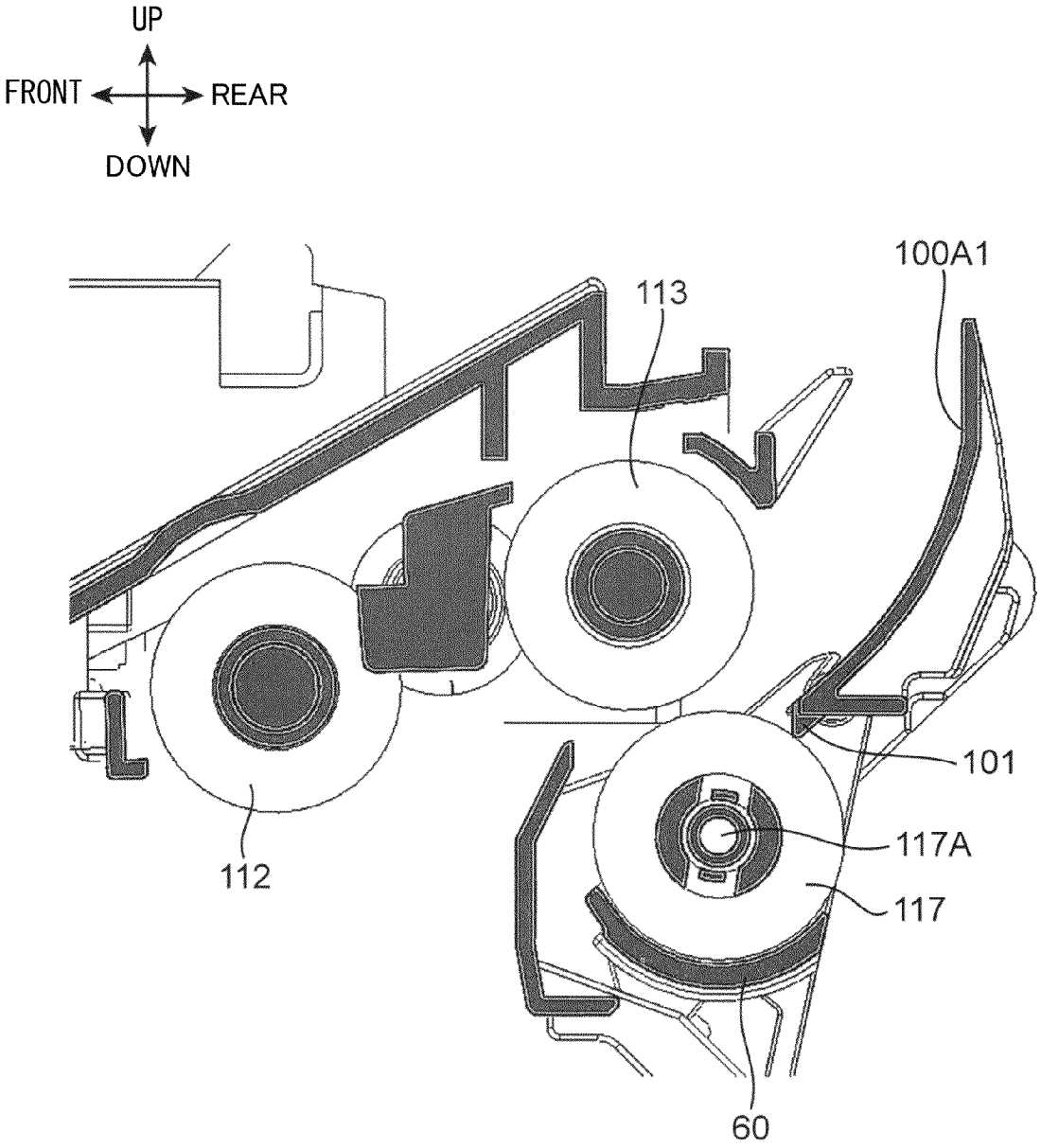
FIG. 11 is a sectional view of the surrounding of the retard roller disposed in a spaced-apart position.

In the present embodiment, the sheet feeding unit 20 includes a contact rib 101 (a contact portion). FIG. 9 is a sectional view of the surrounding of the retard roller 117 disposed in the contact position. FIG. 10 is a sectional view of the surrounding of the retard roller 117 which is being moved away from the sheet feeding roller 113. FIG. 11 is a sectional view of the surrounding of the retard roller 117 disposed in the spaced-apart position.

The contact rib 101 is a rib member that protrudes from the lower end portion of the guide surface central portion 100A1. The contact rib 101 is disposed so as to face the circumferential surface of the retard roller 117. The contact rib 101 is formed of a film member.

In a state in which the retard roller 117 is disposed in the contact position (see FIG. 9), the contact rib 101 is disposed adjacent to the circumferential surface of the retard roller 117 at the sheet-conveyance-direction downstream side of the sheet feeding nip N with a small gap left between the contact rib 101 and the retard roller 117. In the sectional view shown in FIG. 9, the contact rib 101 is disposed at the holder-rotation-direction downstream side (the lower side) of a straight line which interconnects the holder bearing portions 61 (see FIG. 7) and the center of the retard roller 117 (the roller shaft portion 117A). The holder bearing portions 61 are disposed at the sheet-conveyance-direction downstream side of the retard roller 117.

When the retard roller 117 is moved from the contact position to the spaced-apart position, the holder 60 is rotated about the holder bearing portions 61 (FIG. 5) (see an arrow D101 in FIG. 10). The retard roller 117 is moved downward and toward the sheet-conveyance-direction downstream side so as to describe an arc. If the holder 60 rotates, the retard roller 117 begins to move away from the sheet feeding roller 113 and the tip portion of the contact rib 101 makes contact with the circumferential surface of the retard roller 117. As a result, the circumferential surface of the retard roller 117 rotatably supported on the holder 60 is rotated in the direction indicated by an arrow D102 in FIG. 10 just as much as the rotation stroke of the holder 60. Therefore, even when the sheet feeding cassette 110 is drawn out from the body housing 10 in such as a state that the sheet S is sandwiched between the sheet feeding roller 113 and the retard roller 117, the sheet S is sent toward the sheet accommodating portion 1105 (see FIG. 1) of the sheet feeding cassette 110 (toward the sheet-conveyance-direction upstream side) (see an arrow D103 in FIG. 10). Then, the sheet feeding cassette 110 is drawn out in a state in which the retard roller 117 is completely spaced apart from the sheet feeding roller 113 as shown in FIG. 11. As a result, the sheet S is further prevented from staying within the body housing 10. By disposing the contact rib 101 in this way, the retard roller 117 can be reversely rotated toward the sheet-conveyance-direction upstream side using the rotating motion of the holder 60 during the spaced-apart operation of the retard roller 117.

While the sheet feeding unit 20 according to the present embodiment and the image forming apparatus 1 provided with the sheet feeding unit 20 have been described above, the technology of the present disclosure is not limited thereto. For example, the technology of the present disclosure can take the following modified embodiments.

(1) In the aforementioned embodiment, description has been made on an example in which the operating portion 52 operated by a user is provided as the lock mechanism. However, the technology of the present disclosure is not limited thereto. Other lock mechanisms may be employed as the lock mechanism for locking and releasing the drawing-out of the sheet feeding cassette 110. It may be possible to employ an embodiment in which a biasing mechanism for giving a specified click feeling with respect to an operating force when a user draws out the sheet feeding cassette 110 and for locking the drawing-out depending on the click feeling is disposed in the sheet feeding cassette 110.

(2) In the aforementioned embodiment, description has been made on an example in which the lock mechanism 50 and the link portion 51 are disposed so as to face the cassette right wall 110E of the sheet feeding cassette 110. However, the technology of the present disclosure is not limited thereto. The lock mechanism 50 and the link portion 51 may be disposed along the cassette bottom wall 110A of the sheet feeding cassette 110 at the lower side of the sheet feeding cassette 110 or may be disposed in other positions.

What is claimed is:

1. A sheet feeding device, comprising:

an apparatus body;

a sheet feeding cassette capable of being mounted to and removed from the apparatus body along a specified mounting direction, the sheet feeding cassette provided with a sheet accommodating portion within which a sheet is accommodated;

a sheet conveyance path which is disposed in the apparatus body and through which the sheet accommodated within the sheet accommodating portion is conveyed in a sheet conveyance direction extending along the mounting direction;

a sheet feeding roller disposed at an inlet side of the sheet conveyance path so as to face the sheet accommodating portion, the sheet feeding roller rotationally driven to convey the sheet in the sheet conveyance direction;

a retard roller disposed so as to face the sheet feeding roller, the retard roller configured to make contact with the sheet feeding roller to form a sheet feeding nip, through which the sheet passes, between the sheet feeding roller and the retard roller;

a lock mechanism disposed in the sheet feeding cassette and the apparatus body, the lock mechanism configured to lock drawing-out of the sheet feeding cassette from the apparatus body or release the lock; and a separator configured to move the retard roller away from the sheet feeding roller prior to or simultaneously with the lock being released by the lock mechanism.

2. The sheet feeding device of claim 1, wherein the lock mechanism includes a lock unit and a release unit, the lock unit includes an engaged portion disposed in the apparatus body, an engaging portion disposed in the sheet feeding cassette and capable of engaging with the engaged portion, and a first biasing member configured to bias the engaging portion toward the engaged portion, the release unit includes an operating portion disposed in the sheet feeding cassette and capable of rotating about a rotation axis, and a link portion configured to interconnect the operating portion and the engaging portion and connected to the separator, the drawing-out of the sheet feeding cassette is locked as the engaging portion engages with the engaged portion, and the lock is released as the engaging portion is moved away from the engaged portion, and when the operating portion is operated, the link portion operates the separator and moves the retard roller away from the sheet feeding roller prior to or simultaneously with the engaging portion being moved away from the engaged portion.

3. The device of claim 2, wherein the separator includes a holder provided with a pivot portion rotatably pivoted with respect to the apparatus body and configured to rotatably support the retard roller, a second biasing member configured to bias the holder such that the retard roller makes contact with the sheet feeding roller, a pressed portion disposed on the holder so as to face the sheet feeding cassette, and a pressing portion disposed in the link portion and configured to press the pressed portion in conjunction with the operation of the operating portion, and prior to or simultaneously with the engaging portion being moved away from the engaged portion, the pressing portion presses the pressed portion and the holder rotates about the pivot portion to thereby move the retard roller away from the sheet feeding roller.

4. The device of claim 3, wherein the engaged portion is a recess portion formed in a bottom portion of the apparatus body, and the lock unit includes an engaging member provided the engaging portion in a lower end portion thereof and capable of slidingly moving in an up-down direction, and a pushup member which protrudes from the link portion and configured to push the engaging member upward in conjunction with the operation of the operating portion.

5. The device of claim 3, further comprising: a guide wall portion disposed within the apparatus body so as to face the sheet feeding cassette and configured to support the holder; a guide surface disposed on a top surface of the guide wall portion and configured to guide the sheet; and a contact portion disposed in a sheet-conveyance-direction upstream end portion of the guide surface so as to face the retard roller, wherein the pivot portion is disposed at a sheet-conveyance-direction downstream side of the retard roller, while the retard roller is moved away from the sheet feeding roller, the holder rotates about the pivot portion and the retard roller moves downward so as to describe an arc, and while the retard roller makes contact with the sheet feeding roller, the contact portion is disposed adjacent to a circumferential surface of the retard roller at a sheet-conveyance-direction downstream side of the sheet feeding nip and at a holder-rotation-direction downstream side of a straight line which interconnects the pivot portion and the center of the retard roller, the contact portion configured to make contact with the circumferential surface of the retard roller along with the rotation of the holder.

6. The device of claim 5, wherein the contact portion is a rib member which protrudes from the upstream end portion of the guide surface.

7. The device of claim 6, wherein the rib member is formed of a film member.

8. The device of claim 3, wherein the pressing portion is disposed at front end side of the sheet feeding cassette in the mounting direction, and the link portion is disposed so as to face a sidewall of the sheet feeding cassette extending along the mounting direction.

9. The device of claim 2, wherein the sheet feeding cassette includes a grip portion disposed at a rear end side in the mounting direction and gripped when the sheet feeding cassette is mounted to or removed from the apparatus body, and the operating portion is disposed in the grip portion.

10. An image forming apparatus, comprising:

the sheet feeding device of claim 1; and an image forming unit configured to form an image on the sheet conveyed by the sheet feeding roller.

* * * * *